US008957829B2

(12) United States Patent
Zhang et al.

(10) Patent No.: US 8,957,829 B2
(45) Date of Patent: Feb. 17, 2015

(54) ANTENNA MODULE AND METHOD FOR MAKING THE SAME

(75) Inventors: Xue-Li Zhang, Shenzhen (CN); Yong Yan, Shenzhen (CN); Yong-Fa Fan, Shenzhen (CN); Zhao-Yi Wu, Shenzhen (CN); Qi-Yuan Li, Shenzhen (CN); Li Liu, Shenzhen (CN)

(73) Assignee: ScienBiziP Consulting (Shenzhen) Co., Ltd., Guangdong (CN)

( * ) Notice: Subject to any disclaimer, the term of this patent is extended or adjusted under 35 U.S.C. 154(b) by 463 days.

(21) Appl. No.: 13/289,114

(22) Filed: Nov. 4, 2011

(65) Prior Publication Data

US 2012/0287013 A1 Nov. 15, 2012

(30) Foreign Application Priority Data

May 9, 2011 (CN) ..... 2011 1 0117915

(51) Int. Cl.
*H01Q 1/40* (2006.01)

(52) U.S. Cl.
CPC ..... *H01Q 1/40* (2013.01)
USPC ..... 343/873; 29/600

(58) Field of Classification Search
CPC ..... H01Q 1/40; B29C 45/72
USPC ..... 343/783; 29/600; 264/43
See application file for complete search history.

(56) References Cited

U.S. PATENT DOCUMENTS

| | | | | |
|---|---|---|---|---|
| 6,396,451 | B1 | 5/2002 | Wu et al. | |
| 6,613,285 | B1 * | 9/2003 | Carnahan | 422/551 |
| 6,630,911 | B2 * | 10/2003 | Kamei et al. | 343/873 |
| 7,768,461 | B2 * | 8/2010 | Cheng et al. | 343/702 |
| 8,289,216 | B2 * | 10/2012 | Cho et al. | 343/702 |
| 2011/0205141 | A1 * | 8/2011 | Hong et al. | 343/873 |
| 2013/0127684 | A1 * | 5/2013 | Li et al. | 343/873 |

FOREIGN PATENT DOCUMENTS

| | | | |
|---|---|---|---|
| CN | 1365162 | A | 8/2002 |

* cited by examiner

*Primary Examiner* — Tan Ho
(74) *Attorney, Agent, or Firm* — Novak Druce Connolly Bove + Quigg LLP

(57) ABSTRACT

An antenna module includes a main body and a three-dimensional radiator embedded in the main body. The main body is made of foamed ceramic material. A method for making the antenna is also described.

11 Claims, 3 Drawing Sheets

ANTENNA MODULE AND METHOD FOR MAKING THE SAME

BACKGROUND

1. Technical Field

The present disclosure relates to antenna modules, and particularly, to an antenna module used in a portable electronic device and a method for making the same.

2. Description of Related Art

Portable electronic devices can include an antenna module to transmit and receive electromagnetic waves. Recently, more attention has been paid to developing smaller portable wireless terminals. Antennas, as key elements of portable wireless terminals, must be miniaturized accordingly. The radiator of the antenna may also be exposed and easily damaged.

Therefore, there is room for improvement within the art.

BRIEF DESCRIPTION OF THE DRAWINGS

Many aspects of the antenna module and method for making the same can be better understood with reference to the following drawings. The components in the drawings are not necessarily drawn to scale, the emphasis instead being placed upon clearly illustrating the principles of the antenna module and method for making the same. Moreover, in the drawings, like reference numerals designate corresponding parts throughout the several views.

DETAILED DESCRIPTION

Figure 1:
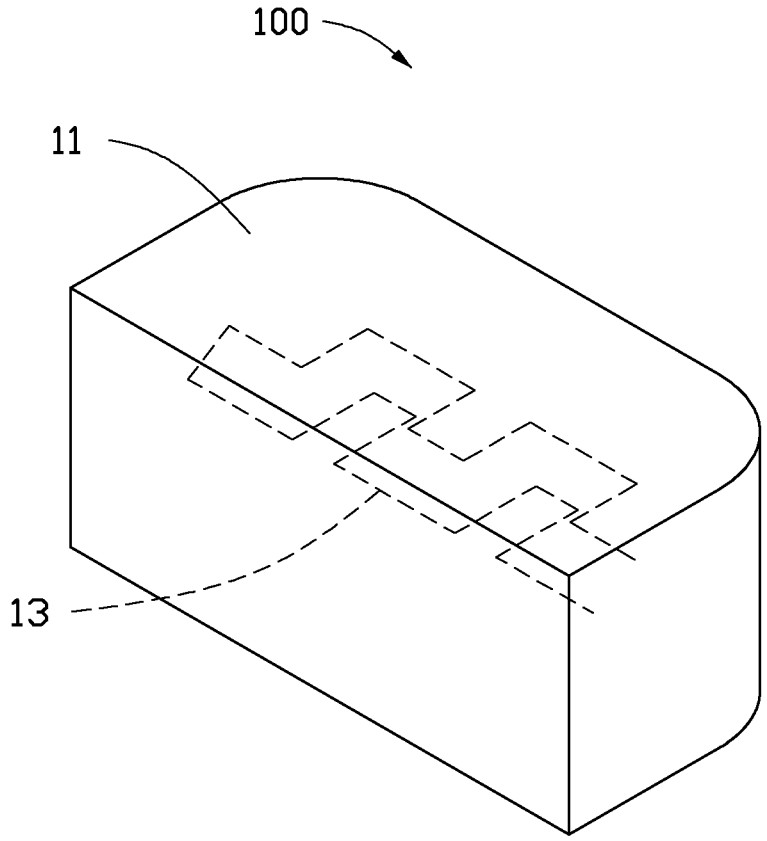
FIG. 1 is a schematic view of an antenna module according to an exemplary embodiment.

Referring to FIG. 1, an antenna module 100 according to one embodiment includes a main body 11 and a three-dimensional radiator 13. The three-dimensional radiator 13 is formed in the main body 11.

The main body 11 is made of foamed ceramics. Foamed ceramics are a kind of porous ceramics which have many good properties, such as chemical stability, low heat exchange. In the exemplary embodiment, the process of manufacturing the main body 11 includes at least the following steps: providing foamed ceramic raw material; forming the foamed ceramic raw material to a preformed body through injection molding; sintering the preformed body to form the main body 11.

The three-dimensional radiator 13 is made of metallic materials, and a melting point of the metallic material is higher than a sintering temperature of the foamed ceramic material. Generally, the sintering temperature of the foamed ceramic material is between 1000° C.~1600° C. In this embodiment, the three-dimensional radiator 13 is made of nickel-titanium alloy. A range of the melting point of the nickel-titanium alloy is 1240° C.~1310° C. During manufacturing, it is desired that the sintering temperature of the foamed ceramic material is lower than the melting point of the nickel-titanium alloy to avoid melting of the nickel-titanium alloy. The nickel-titanium alloy is pressed or molded to form the three-dimensional radiator 13.

Figure 2:
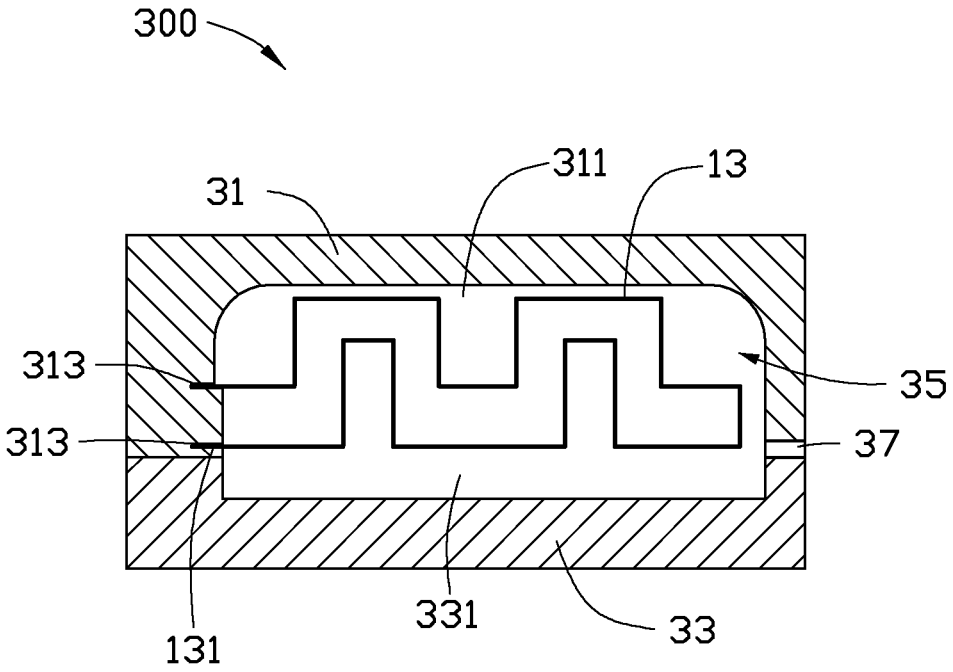
FIG. 2 is a cross-sectional view of a radiator of the antenna module formed in an injection molding machine according to the exemplary embodiment.
Figure 3:
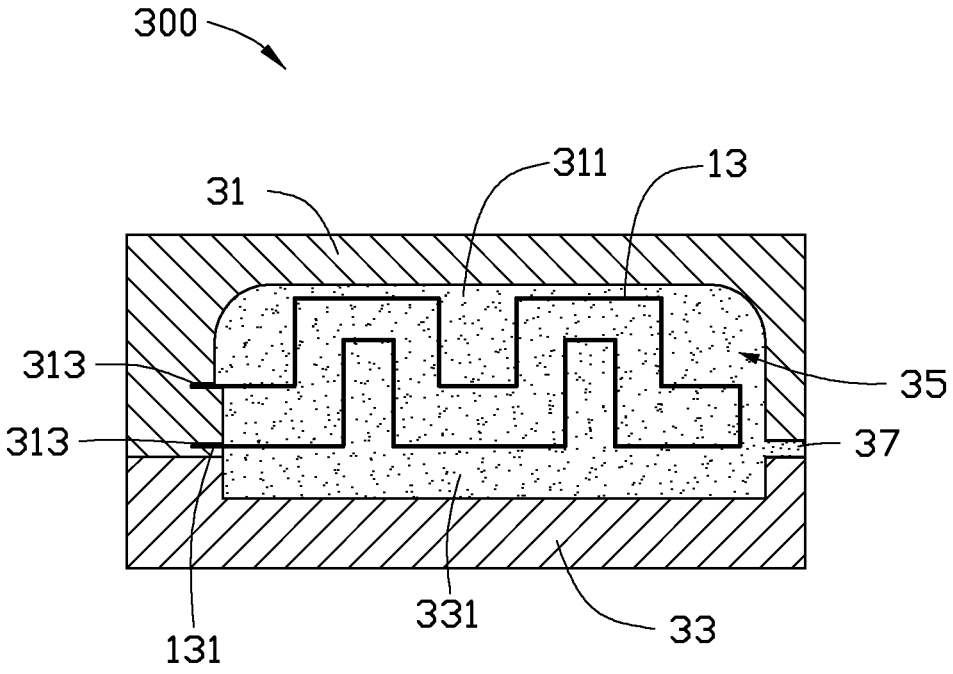
FIG. 3 is similar to FIG. 2, but the injection molding machine is filled with foamed ceramic raw materials.

Referring to FIG. 2 and FIG. 3, a method for manufacturing the antenna module 100 is described as follows:

An injection molding machine 300 is used for forming the antenna module 100. The injection molding machine 300 includes an upper mold 31 and a lower mold 33. A sprue 37 is formed between the upper mold 31 and the lower mold 33. The upper mold 31 includes a first cavity 311, and the lower mold 33 includes a second cavity 331. The first cavity 311 and the second cavity 331 enclose a die cavity 35 together. The shape of at least one of the first cavity 311 and the second cavity 331 corresponds to one portion of a portable electronic device, which is for containing the antenna module 100.

The three-dimensional radiator 13 is put into the die cavity 35 and fixed in the die cavity 35. In this embodiment, two slots 313 are defined in an inner surface of the upper mold 31. The three-dimensional radiator 13 includes two extending portions 131 corresponding to the two slots 313. Each extending portion 131 is received in one slot 313 to fix the three-dimensional radiator 13 in the die cavity 35.

Foamed ceramic raw material in a form of slurry is injected into the die cavity 35 via the sprue 37 to form into a preformed body. The two extending portions 131 are completely received in the slots 313, and the two extending portions 131 cannot contact with the foamed ceramic raw materials during the injection molding process. The preformed body enclosing the three-dimensional radiator 13 is taken out from the injection molding machine 300, and is put into a sintering furnace (not shown) for sintering. The sintering temperature is lower than the melting point of the three-dimensional radiator 13. The sintered preformed body is formed into the main body 11, and the three-dimensional radiator 13 is embedded in the main body 11.

The two extending portions 131 cannot contact with the foamed ceramic raw materials during the injection molding process, thus, the two extending portions 131 are exposed out of the main body 11. The two extending portions 131 functions as connection terminals of the antenna module 100 for electronically connecting other printed circuit boards. In another embodiment, the two extending portions 131 can be cut off and the three-dimensional radiator 13 is directly connected to the printed circuit boards. In FIG. 1, the two extending portions 131 have been cut off.

The main body 11 protects the three-dimensional radiator 13 from damage. The main body 11 is a foamed ceramic body with high temperature resistance, corrosion resistance, lightweight, and increases the lifetime of the antenna module 100. The main body 11 is formed through injection molding, and the shape of the main body 11 corresponds to the antenna module 100's installation location on a portable electronic device. The antenna module 100 is easy to assemble.

In another exemplary embodiment, the slots 313 are defined on an inner surface of the lower mold 33.

It is believed that the present embodiments and their advantages will be understood from the foregoing description, and it will be apparent that various changes may be made thereto without departing from the spirit and scope of the disclose or sacrificing all of its material advantages, the examples hereinbefore described merely being preferred or exemplary embodiments of the disclosure.

What is claimed is:

1. An antenna module comprising:

a main body; and a three-dimensional radiator embedded in the main body;

wherein the main body is made of foamed ceramic material, the main body is formed by which foamed ceramic raw materials are molded into a preformed body, and the preformed body is sintered to form the main body.

2. The antenna module as claimed in claim 1, wherein the three-dimensional radiator is made of metallic material, and a melting point of the metallic materials is higher than a sintering temperature of the foamed ceramic material.

3. The antenna module as claimed in claim 1, wherein the three-dimensional radiator is made of nickel-titanium alloy.

4. The antenna module as claimed in claim 3, wherein the nickel-titanium alloy is pressed or molded to form the three-dimensional radiator.

5. The antenna module as claimed in claim 1, wherein the three-dimensional radiator includes at least one extending portion which has no contact with the foamed ceramic raw materials during the injection molding process.

6. A method for making an antenna module, the method comprising:

providing a injection molding machine including a die cavity;

putting a three-dimensional radiator into the die cavity and fixing the three-dimensional radiator in the die cavity;

injecting foamed ceramic raw materials to the die cavity to form a preformed body;

removing the preformed body and the three-dimensional radiator embedded in the preformed body from the injection molding machine;

sintering the preformed body and the three-dimensional radiator in a sintering furnace to form the antenna module .

7. The method as claimed in claim 6, wherein the injection molding machine includes an upper mold, and a lower mold, a sprue is formed between the upper mold and the lower mold, the upper mold includes a first cavity, and the lower mold includes a second cavity, the first cavity and the second cavity enclose the die cavity together.

8. The method as claimed in claim 7, wherein an inner surface of the upper mold or the lower mold defines at least one slot.

9. The method as claimed in claim 8, wherein the three-dimensional radiator includes at least one extending portion which has no contact with the foamed ceramic raw materials during the injection molding process, the at least one extending portion is received in the at least one slot.

10. The antenna module as claimed in claim 6, wherein the three-dimensional radiator is made of metallic material, and a melting point of the metallic material is higher than a sintering temperature of the foamed ceramic body.

11. The antenna module as claimed in claim 6, wherein the three-dimensional radiator is made of nickel-titanium alloy.

* * * * *